US007677333B2

(12) United States Patent
Mensa-Wilmot

(10) Patent No.: US 7,677,333 B2
(45) Date of Patent: Mar. 16, 2010

(54) DRILL BIT WITH MULTIPLE CUTTER GEOMETRIES

(75) Inventor: Graham Mensa-Wilmot, Spring, TX (US)

(73) Assignee: Varel International Ind., L.P., Carrollton, TX (US)

( * ) Notice: Subject to any disclaimer, the term of this patent is extended or adjusted under 35 U.S.C. 154(b) by 195 days.

(21) Appl. No.: 11/406,470

(22) Filed: Apr. 18, 2006

(65) Prior Publication Data

US 2007/0240905 A1 Oct. 18, 2007

(51) Int. Cl.
*E21B 10/43* (2006.01)

(52) U.S. Cl. ..... 175/57; 175/431; 175/430; 175/379

(58) Field of Classification Search ..... 175/57, 175/430, 431, 379
See application file for complete search history.

(56) References Cited

U.S. PATENT DOCUMENTS

| | | | | |
|---|---|---|---|---|
| 5,238,075 | A | | 8/1993 | Keith et al. |
| 5,265,685 | A | | 11/1993 | Keith et al. |
| 5,549,171 | A | | 8/1996 | Mensa-Wilmot et al. |
| 5,551,522 | A | | 9/1996 | Keith et al. |
| 5,582,261 | A | | 12/1996 | Keith et al. |
| 5,592,996 | A | | 1/1997 | Keith et al. |
| 5,607,024 | A | | 3/1997 | Keith et al. |
| 5,607,025 | A | | 3/1997 | Mensa-Wilmot et al. |
| 5,816,346 | A | * | 10/1998 | Beaton ..... 175/431 |
| 5,937,958 | A | | 8/1999 | Mensa-Wilmot et al. |
| 6,123,161 | A | * | 9/2000 | Taylor ..... 175/397 |
| 6,164,394 | A | | 12/2000 | Mensa-Wilmot et al. |
| 6,564,886 | B1 | | 5/2003 | Mensa-Wilmot et al. |
| 2002/0033077 | A1 | * | 3/2002 | Griffin et al. ..... 76/108.2 |
| 2003/0034180 | A1 | * | 2/2003 | Mensa-Wilmot ..... 175/420.2 |
| 2006/0070771 | A1 | * | 4/2006 | McClain et al. ..... 175/57 |

* cited by examiner

*Primary Examiner*—Jennifer H Gay
*Assistant Examiner*—David Andrews
(74) *Attorney, Agent, or Firm*—Gardere Wynne Sewell LLP

(57) ABSTRACT

A drill bit has cutting elements with multiple cutting surface geometries that are positioned so that their cutting profiles overlap, but do not completely contain or engulf one another. The different cutting surface geometries and the specific overlap create a zone of high density in the middle regions of the cutting profiles and low density in the periphery, resulting in a cutting profile that becomes sharper with increasing wear. Such an arrangement is more effective and stable as the drill bit encounters hard and abrasive formation materials. Moreover, cutting elements with larger axial volumes may be combined with cutting elements having smaller axial volumes, resulting in an even more effective drill bit in terms of durability and ability to drill efficiently in hard and abrasive formations.

30 Claims, 7 Drawing Sheets

DRILL BIT WITH MULTIPLE CUTTER GEOMETRIES

FIELD OF THE INVENTION

The present invention relates to rotary drill bits for rotary drilling of subterranean formations and, more specifically, to a rotary drill bit having cutting elements with multiple geometries and arranged so that the drill bit becomes more stable and mechanically more efficient with increasing wear on the cutting elements.

BACKGROUND OF THE INVENTION

Subsurface formation drilling to recover hydrocarbons is well known in the art. The equipment for such subsurface formation drilling typically comprises a drill string having a rotary drill bit attached thereto that is lowered into a borehole. A rotary table or similar device rotates the drill string, resulting in a corresponding rotation of the drill bit. The rotation advances the drill bit downwardly, causing it to cut through the subsurface formation (e.g., by abrasion, fracturing, and/or shearing action). Drilling fluid is pumped down a channel in the drill string and out the drill bit to cool the bit and flush away debris that may have accumulated. The drilling fluid travels back up the borehole through an annulus formed between the drill string and the borehole.

Many types of drill bits have been developed, including roller cone bits, fixed cutter bits (or "drag bits"), and the like. For each type of drill bit, several patterns of cutting elements (or "cutters") are possible, including spiral patterns, straight radial patterns, and the like. Different types of cutting elements have also been developed, including milled cutting elements, tungsten carbide inserts ("TCI"), polycrystalline-diamond compacts ("PDC"), and natural diamond cutting elements. The selection of which drill bit, cutting element type, and cutting element pattern to use for a given subsurface formation can depend on a number of factors. For example, certain combinations of drill bit, cutting element type, and cutting element pattern drill more efficiently and effectively in hard formations than others. Another factor is the range of hardness encountered when drilling through the different formation layers.

One common pattern for drill bit cutting elements is to arrange them in a spiral configuration, an example of which is shown in FIGS. 1A-1B. As can be seen, a spiral pattern drill bit 100 is composed of several sections, including a bit body 102, a shank 104, and a threaded connector 106 for connecting the drill bit 100 to a drill string. Flats 108 on the shank 104 allow a tool, such as wrench, to grip the drill bit 100, making it possible (or at least easier) to screw the drill bit 100 onto the drill string. Blades 110*a*, 110*b*, 110*c*, 110*d*, 110*e*, and 110*f* are formed on the drill bit 100 for holding a plurality of cutting elements 112. The cutting elements 112 include superabrasive faces that usually have identical geometries (i.e., size, shape, and orientation), although different positions and/or cutting angles on the blades 110*a-f*. Also visible are drill fluid outlets 114 that conduct the drilling fluid out of the drill bit 100, carrying away any debris and cuttings that may have accumulated.

In the spiral configuration and other radial configuration drill bits, the cutting elements 112 are placed at selected radial positions with respect to a central longitudinal axis A. In addition, the positions of the cutting elements 112 on one blade 110*a-f* are staggered relative to the positions of the cutting elements 112 on another blade 110*a-f*. The result is that a cutting surface of one cutting element 112 overlaps the cutting surface of at least one other cutting element 112 in their cutting profiles, which is the area outlined by the cutting surfaces when the cutting elements are rotated onto the same radial plane. Thus, each cutting element 112 removes a lesser volume of material than would be the case if it were positioned so that no overlapping occurred.

FIGS. 2A-2C illustrate the overlap via a segment of a drill bit's cutting profile 200 for the drill bit 100. Note that the portions of the blades 110*a-f* shown in FIGS. 2A-2C have been flattened out in order to more clearly illustrate the shortcomings of existing drill bits. Those having ordinary skill in the art will recognize that, in practice, the blades of a drill bit frequently have some degree of curvature.

As can be seen, the profile segment 200 is composed of several individual cutting profiles 202*a*, 202*b*, 202*c*, and 202*d* representing the various cutting elements 112 (see FIG. 1) on the blades 110*a-f*. The cutting profiles 202*a-d* show the area outlined by the cutting surfaces of the cutting elements 112 when they are all rotated onto the same radial plane. Thus, the profile segment 200 may be shared by the cutting elements 112, denoted herein by cutting profiles 202*a*, 202*b*, 202*c*, or 202*d*, even though the cutting elements 112 may physically reside on different blades 110*a-f*, have different radial positions on the blades 110*a-f*, and follow different paths in the subsurface formation as the bit is rotated. This arrangement ensures substantially complete coverage of the bottom hole as the bit is rotated during the drilling process.

The overlap can be seen in more clearly FIG. 2B, where the cutting surfaces represented by the first and second cutting profiles 202*a* and 202*b* overlap when rotated onto the same radial plane. Similarly, the cutting surfaces represented by the second and third cutting profiles 202*b* and 202*c* overlap when rotated onto the same plane. Likewise, the cutting surfaces represented by the third and fourth cutting profiles 202*c* and 202*d* overlap when rotated onto the same plane.

The overlap helps provide greater coverage for the borehole bottom, but can result in a specific wear pattern that, depending on the location of the wear, may drastically blunt the cutting elements 112, causing severe reductions in ROP. In the specific example shown, the overlap occurs mainly on the sides 204 of the cutting profiles 200*a-d*. As a result of the overlaps, the cutting element density in those areas 204 is necessarily greater than the density in the tip regions 206 of the cutting profiles 200*a-d*. Consequently, the cutting elements, as shown by the individual cutting profiles 202*a-d* along the segment of the bit's profile 200, tend to wear down more quickly in the tip regions 206, which happen to be the most mechanically efficient portion of the cutting element. This is indicated by the cutting profiles 202*a'-d'* of FIG. 2C.

Accelerated or pronounced wear in the most mechanically efficient portions of the cutting elements is not a great hindrance in comparatively soft formation materials, where rates of penetration (ROP) are usually higher and less energy is usually required to fail the rock being drilled. However, for hard formations, the tip regions of the cutting surfaces are the most effective portions for shearing (in the case of shale, sandstone, and siltstone) or fracturing (in the case of limestone and dolomite) the rock being drilled. For these subsurface formations, a drill bit where the cutting elements exhibit accelerated cutter tip wear (based on the cutting profile) can significantly reduce the ROP. This wear pattern can also minimize a drill bit's effectiveness at combating damaging vibrations, specifically lateral vibrations and bit whirl, due to the resulting bottomhole pattern that is created as a result of the wear. Stabilization forces that normally act to re-stabilize the bit at the initiation of an off-center movement and/or rotation are minimized, making bits with pronounced cutter tip wear patterns prone to intense vibrations.

Thus, despite certain advances made in the industry, there remains a need for a drill bit having an improved cutting element arrangement that will permit the bit to drill effectively at good or economical ROPs, and provide increased stability and enhanced mechanical efficiency as wear occurs, especially in hard formations, and in deep harsh drilling environments, where the time and expense needed to retrieve and replace ineffective and un-stable drill bits substantially increase overall drilling operational costs.

SUMMARY OF THE INVENTION

Embodiments of the invention are directed to a drill bit, and method of assembling same, that becomes more effective mechanically, and also gains in stability with increasing wear. The drill bit has cutting elements with multiple cutting surface geometries that are positioned so that their cutting profiles overlap, but do not completely contain or engulf one another. The different cutting surface geometries and specific overlap of the cutting elements define zones of different cutting element densities in the cutting surface and along the bit's profile. In one implementation, the overlap occurs in the middle regions of the cutting profiles, resulting in a zone of higher density in the middle regions that extends to the tip, but lower density on the periphery. The higher density middle regions and lower density periphery has the effect of sharpening the tip regions of the cutting surfaces as wear progresses, making the cutting elements increasingly effective during the drilling process. Moreover, cutting elements having larger axial volumes may be combined with cutting elements having smaller axial volumes, resulting in an even more effective drill bit in terms of durability and ability to drill efficiently in hard and abrasive formations.

In general, in one aspect, the invention is directed to a drill bit. The drill bit comprises a drill bit body and first and second blades formed on the drill bit body. The drill bit further comprises a first cutting element mounted on the first blade, the first cutting element having a first cutting surface geometry corresponding to a first cutting profile, and a second cutting element mounted on the second blade, the second cutting element having a second cutting surface geometry corresponding to a second cutting profile. The first and second cutting elements are positioned on the first and second blades, respectively, so that the first and second cutting profiles partially overlap each other without completely containing each other, the overlap creating a high-density zone in a middle region of the first and second cutting profiles and a low-density zone on a periphery of the first and second cutting profiles.

In general, in another aspect, the invention is directed to a method of assembling a drill bit. The method comprises providing a drill bit body having first and second blades formed thereon and mounting a first cutting element on the first blade, the first cutting element having a first cutting surface geometry corresponding to a first cutting profile. The method further comprises mounting a second cutting element on the second blade, the second cutting element having a second cutting surface geometry corresponding to a second cutting profile. The first and second cutting elements are positioned on the first and second blades, respectively, so that the first and second cutting profiles partially overlap each other without completely containing each other, the overlap creating a high-density zone in a middle region of the first and second cutting profiles and a low-density zone on a periphery of the first and second cutting profiles.

In general, in still another aspect, the invention is directed to a method of assembling a drill bit. The method comprises providing a drill bit body having first and second blades formed thereon, at least one of the first and second blades being capable of supporting two rows of cutting elements. The method further comprises mounting a first row of cutting elements and a second row of cutting elements on the at least one of the first and second blades, the cutting elements of the first and second rows having different cutting surface geometries, respectively. The first row of cutting elements is spaced angularly apart from the second row of cutting elements, and at least one cutting element on the first row and at least one cutting element on the second row have cutting profiles that overlap radially, but without completely containing each other.

In general, in still another aspect, the invention is directed to a method of drilling through a subsurface formation using a drill bit. The method comprises drilling through a first formation material using the drill bit, the drill bit having cutting elements with multiple cutting surface geometries that partially overlap one another, but without completely containing each other, when rotated onto a same radial plane. The method further comprises drilling through a second formation material using the drill bit, the second formation material being located below the first formation material and harder and more abrasive than the first formation material. Drilling through the second formation material causes a periphery of at least one of the cutting elements to wear away faster than a middle region of the at least one of the cutting elements.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent from the following detailed description and upon reference to the drawings, wherein.

DESCRIPTION OF ILLUSTRATIVE EMBODIMENTS OF THE INVENTION

Following is a detailed description of the invention with reference to the drawings. It should be noted that the drawings are provided for illustrative purposes only and are not intended to be a blueprint or manufacturing drawings, nor are they drawn to any particular scale.

As mentioned above, existing fixed cutter drill bits have cutting elements that have identical cutting surface geometries and are arranged on the blades so that they radially overlap on the periphery of their cutting profiles. The term "geometry" refers to the size, shape, and orientation of the cutting surfaces, but not their positioning or cutting angle on the blades. For bits where each radial position is unique, the peripheral overlap creates a smooth wear pattern that can drastically reduce ROP especially in hard formations. For bits where multiple cutting elements share a common radial position, the peripheral overlaps initially locate cutter wear at the tips of the cutting elements. The resulting wear patterns from existing cutter arrangements have the same negative effects on ROP and bit stabilization. The wear patterns in these instances reduce mechanical efficiency and thus ROP, especially in hard formations, forcing the use of high energy levels (e.g., via weight on bit (WOB) and/or RPM (revolutions per minutes)) in order to achieve acceptable ROPs, conditions that further compound the wear process and its negative effects. In addition, bit stabilization is also compromised as cutter wear progresses.

Embodiments of the invention provide a fixed cutter drill bit where the cutting elements have different cutting surface geometries that overlap each other in the middle regions of their cutting profiles. The multiple cutting surface geometries and specific overlap of the cutting profiles create a zone of higher cutter element density in the middle regions extending to the tips, but lower density on the periphery. The result is a drill bit where the cutting elements acquire more sharply defined tip regions as wear progresses. Such an arrangement can produce higher ROPs and greater stability, especially when the drill bit advances into hard and abrasive formation materials. Moreover, cutting elements having larger axial volumes are also used to enhance the durability and, hence, effectiveness of the drill bit even further, advantages that are critical in order to achieve needed performance improvements in hard and abrasive formation.

Figure 3:
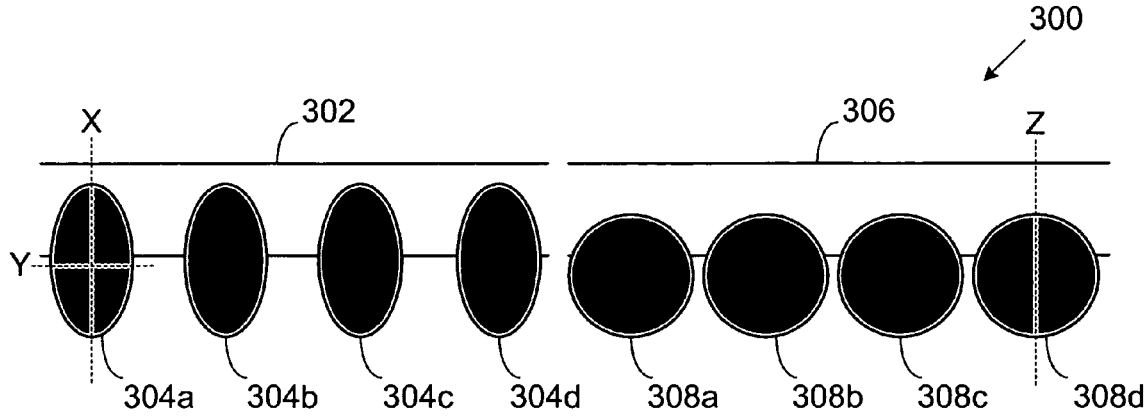
FIG. 3 illustrates an exemplary arrangement for a fixed cutter drill bit having cutting elements with multiple cutting surface geometries according to embodiments of the invention.

Referring now to FIG. 3, a partial view of a fixed cutter drill bit 300 having cutting elements with multiple cutting surface geometries according to embodiments of the invention is shown. The cutting elements may be any suitable type of cutting element known to those having ordinary skill in the art, including TCI cutting elements, PDC cutting elements, natural diamond cutting elements, or some combination thereof. Note in FIG. 3 and all remaining applicable drawings that the portions of the blades shown have been flattened out in order to more clearly illustrate the principles and teachings of the present invention. Those having ordinary skill in the art will understand that actual blades may have some degree of curvature. In addition, to avoid unnecessarily cluttering the drawing, various details of the drill bit 300 have been omitted and only the cutting surfaces of a few cutting elements are illustrated. It should also be reiterated that the drawings are provided for illustrative purposes alone and are not drawn to any specific scale, particularly with respect to the location of and spacing between the various cutting elements.

Figure 1A:
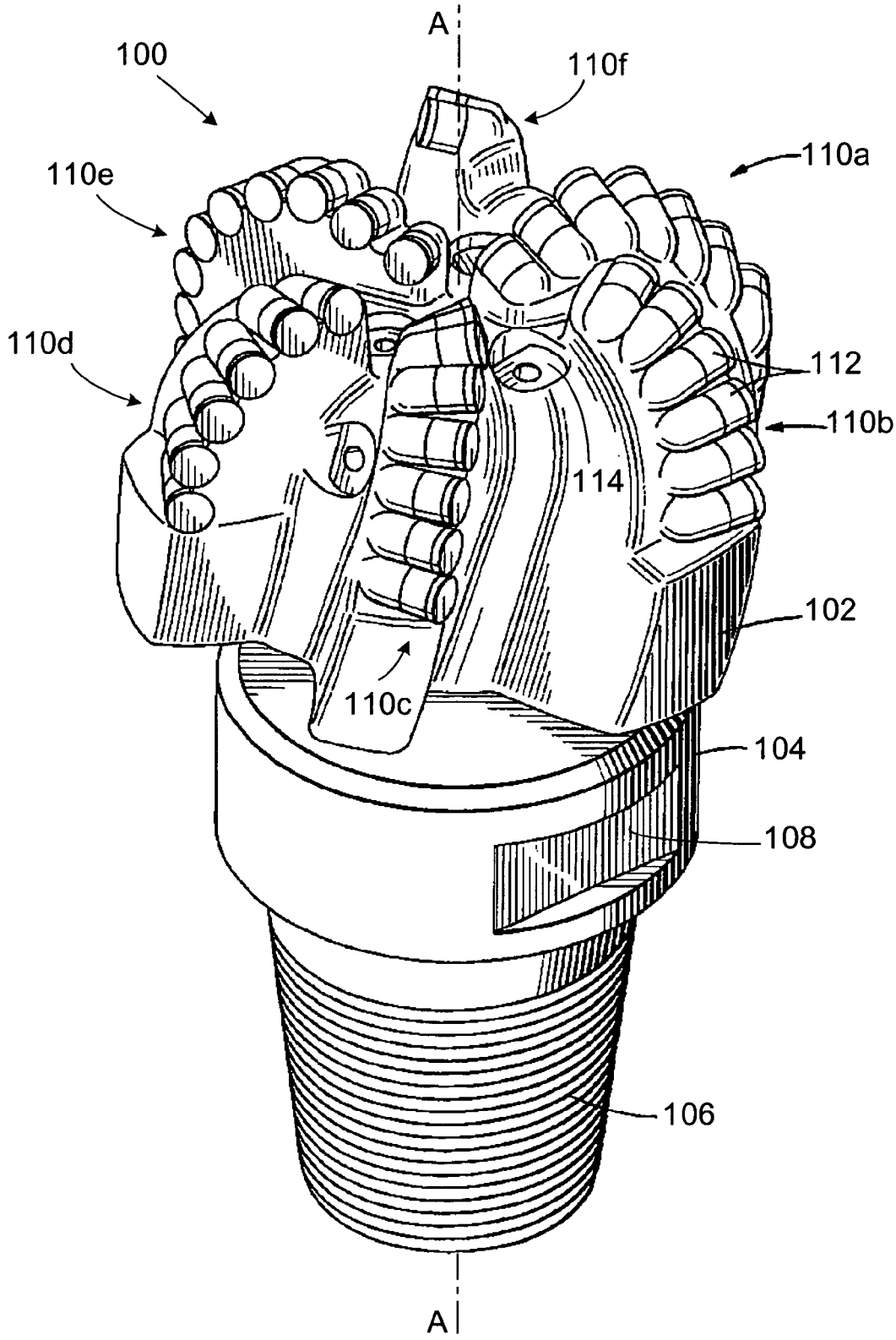
FIG. 1A (Prior Art)
FIGS. 1A-1B, described previously, illustrate a side view and a bottom view of a prior art fixed cutter drill bit.
Figure 1B:
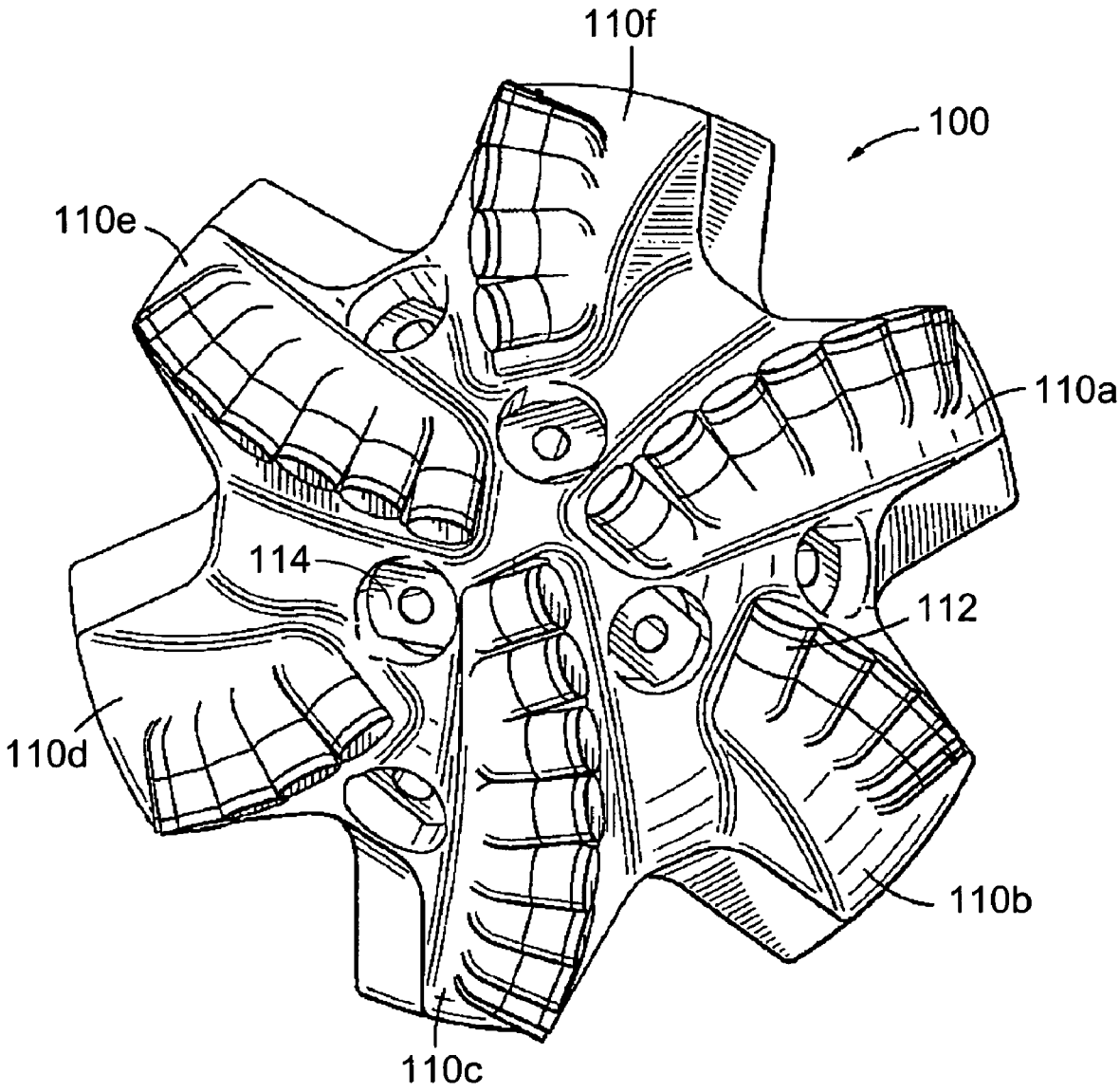
FIG. 1B (Prior Art)
Figure 2A:
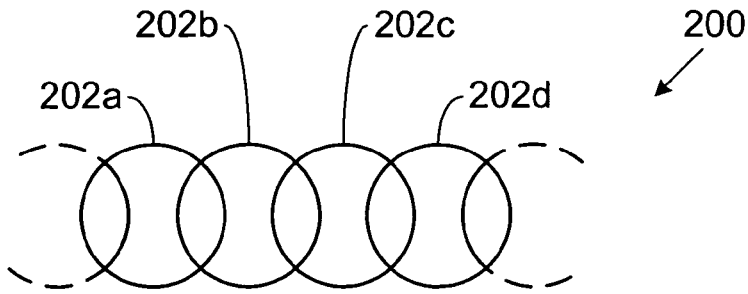
FIG. 2A (Prior Art)
FIGS. 2A-2C, described previously, illustrate cutting profiles for a prior art fixed cutter drill bit.
Figure 2B:
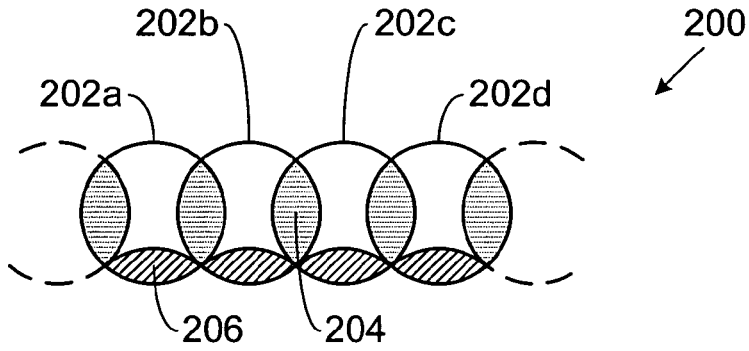
FIG. 2B (Prior Art)
Figure 2C:
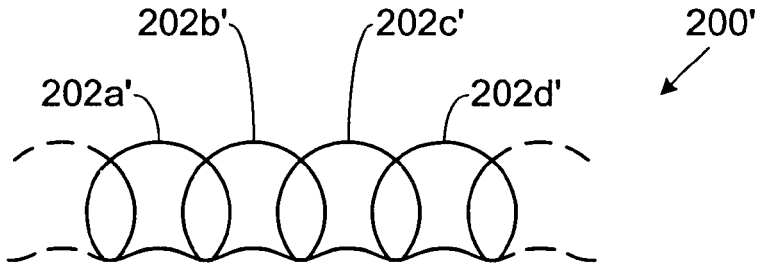
FIG. 2C (Prior Art)

As can be seen, at least one blade 302 (similar to blades 110*a-f* of FIGS. 1A-1B) of the drill bit 300 has a plurality of cutting elements 304*a-d* having one cutting surface geometry mounted thereon, and at least one other blade 306 (similar to blades 110*a-f* of FIGS. 1A-1B) has a plurality of cutting elements 308*a-d* having a different cutting surface geometry mounted thereon. These cutting surface geometries may have shapes such as, for example, round shapes, oval shapes, including elliptical, egg-shaped, pear-shaped, teardrop, and the like, as well as other common and customized shapes known to those having ordinary skill in the art. The term "oval" as used herein refers to any shape that is closed and smooth (i.e., has a finite derivative at all points). In some cases, even non-circular shapes may be used where at least a portion of the cutting surface shape is flat.

For the specific implementation of FIG. 3, the first set of cutting elements 304*a-d* has an oval cutting surface oriented so that a major (i.e., long) axis X extends generally perpendicular to a profile of the drill bit and 300, but may also be generally parallel to a central axis (see FIG. 1A) of the drill bit, while a minor (i.e., short) axis Y extends generally parallel to the profile of the drill bit, but may also be generally perpendicular to the central axis of the drill bit. The second set of cutting elements 308*a-d*, on the other hand, have a round cutting surface, with a cutting surface diameter that is equal to, less than, or greater than a cutting surface width of the oval cutting elements 304*a-d* (as measured along the minor axis Y) and less than a cutting surface length of the oval cutting elements 304*a-d* (as measured along the major axis X). The result is that the round cutting elements 308*a-d* do not fully contain or engulf the oval cutting elements 304*a-d*, and vice versa, when rotated onto the same radial plane.

In accordance with embodiments of the invention, the oval cutting elements 304*a-d* and the round cutting elements 308*a-d* are positioned on their respective blades 302 and 306 so that at least one oval cutting element 304*a-d* and at least one round cutting element 308*a-d* partially overlap in the middle when rotated onto the same radial plane. That is, the major axis X of at least one oval cutting element 304*a-d* and a corresponding axis Z of at least one round cutting element 308*a-d* substantially line up when the cutting elements are rotated onto the same radial plane. Such an arrangement causes the overlap to occur mostly in the middle regions and not on the periphery, resulting in a zone of higher density in the middle regions extending to the tips, but lower density on the periphery of the cutting elements.

Figure 4:
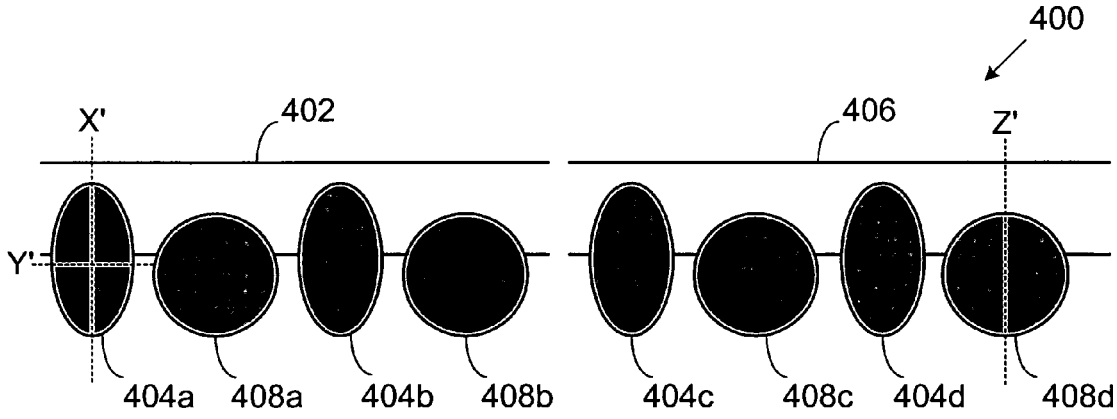
FIG. 4 illustrates another exemplary arrangement for a fixed cutter drill bit having cutting elements with multiple cutting surface geometries according to embodiments of the invention.

FIG. 4 illustrates an alternative arrangement to FIG. 3 in that the same blade may contain cutting elements with different cutting surface geometries. As can be seen in FIG. 4, a drill bit 400 includes at least one blade 402 (similar to blades 110*a-f* of FIGS. 1A-1B) containing a mix of oval and round cutting elements 404*a-d*, and at least one other blade 406 (similar to blades 110*a-f* of FIGS. 1A-1B) also containing a mix of oval and round cutting elements 408*a-d*. The oval cutting elements 404*a-d* are again oriented so that a major axis X' of their cutting surface extends generally perpendicular to a profile of the drill bit 400, but may also be generally parallel to a central axis of the drill bit, wall a minor axis Y' extends generally parallel to the profile of the drill bit, but may also be generally perpendicular to the central axis of the drill bit.

The mixing of the different cutting surface shapes on individual blades 402 and 406 on the drill bit 400 shown in FIG. 4 results in substantially the same partial overlap of cutting surfaces as the drill bit 300 shown in FIG. 3. However, based on the different rock failure mechanisms of round cutting elements (primarily shear) and oval cutting elements (primarily pre-fracture), the drilling efficiencies of the different blades will be dissimilar for the two layouts. The cumulative total wear flat areas on the individual blades will also be different and will have dissimilar effects on overall drilling performance.

In the embodiment of FIG. 4, the major axis X' of at least one oval cutting element 404*a* and 404*b* on one blade 402 and a corresponding axis Z' of at least one round cutting element 408*c* and 408*d* on one other blade 406 substantially line up when the cutting elements are rotated onto the same plane. However, for both FIGS. 3 and 4, the benefits of the invention may be achieved even when the X and X' axes of the oval cutting elements 304*a-d* and 404*a* & 404*b* and the Z and Z' axes of the round cutting elements 308*a-d* and 408*c* & 408*d* do not line up, so long as neither cutting element type is totally contained or engulfed within the periphery of the other cutting element type (based on their cutting profiles).

Figure 5A:
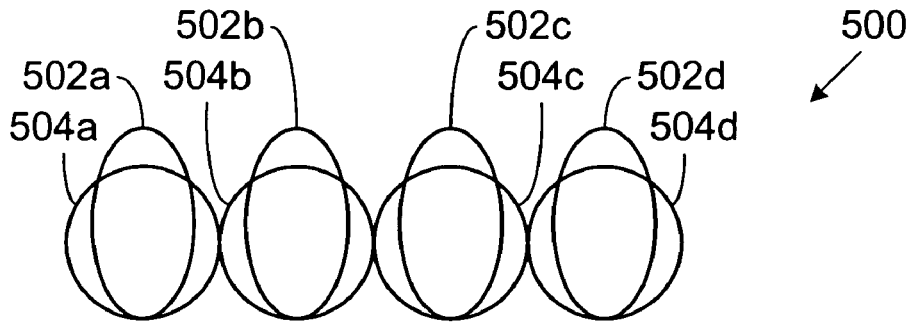
FIGS. 5A-5C illustrate cutting profiles for an exemplary fixed cutter drill bit having cutting elements with multiple cutting surface geometries according to embodiments of the invention.
Figure 5B:
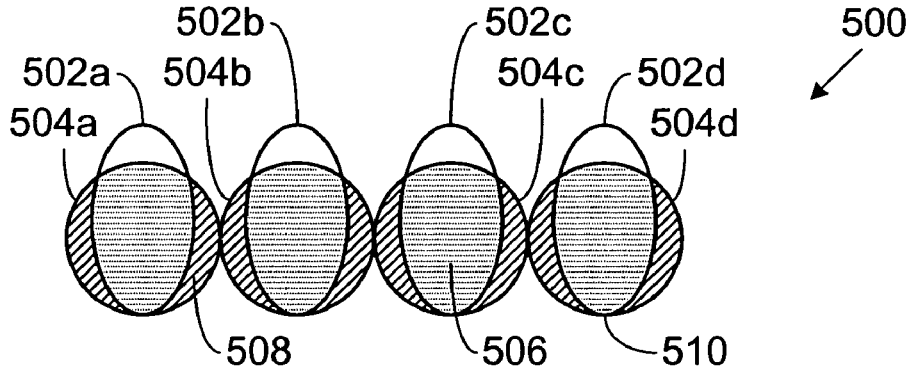
Figure 5C:
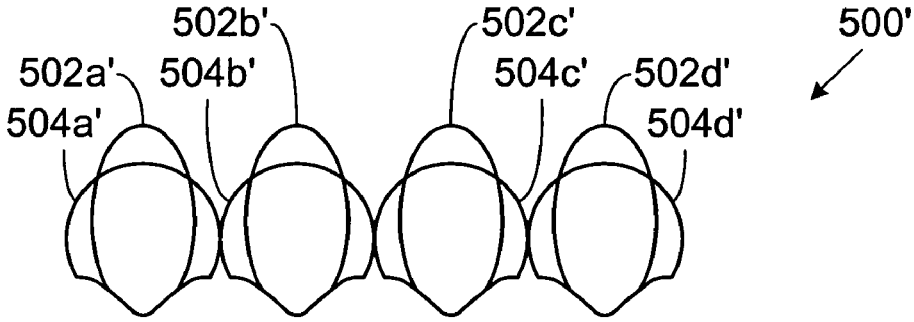

FIGS. 5A-5C show cutting profiles for an exemplary fixed cutter drill bit having cutting elements with multiple cutting surface geometries according to embodiments of the invention. As mentioned above, a cutting profile is the region outlined by the cutting surfaces of the cutting elements when they are rotated onto the same radial plane. The cutting profiles in FIGS. 5A-5C may represent a fixed cutter drill bit similar to that shown in FIG. 3, or they may represent a fixed cutter drill bit similar to that shown in FIG. 4, or they may represent some other fixed cutter drill bit.

Referring first to FIG. 5A, a cutting profile 500 according to embodiments of the invention may include cutting profiles 502*a-d* representing cutting elements having one cutting surface geometry and cutting profiles 504*a-d* representing cutting elements having a different cutting surface geometry. These cutting surfaces may result in cutting profiles 502*a-d* and 504*a-d* having shapes such as, for example, round shapes, oval shapes (e.g., elliptical, egg-shaped, pear-shaped, teardrop, etc.) and even non-circular shapes. For the particular embodiment shown, the first set of cutting profiles 502*a-d* has an oval shape oriented so that a major axis (see FIGS. 3-4) extends generally perpendicular to a profile of the drill bit (not expressly shown) and a minor axis (see FIGS. 3-4) extends generally parallel to the profile of the drill bit. The second set of cutting profiles 504*a-d*, on the other hand, are round, with a diameter that is at least equal to or greater than the width of the oval cutting profiles 504*a-d* (as measured along the minor axis) and equal to or less than the length of the oval cutting profiles 504*a-d* (as measured along the major axis). In a preferred embodiment, at least a portion of the oval cutting profiles 502*a-d* extends beyond the round cutting profiles 504*a-d*, and vice versa, so that the cutting profiles 502*a-d* and 504*a-d* do not completely contain or engulf one another. Additionally, the tips 510 of the oval cutting profiles 502*a-d* and the round cutting profiles 504*a-d* reflect the fact that the cutting elements are set to substantially the same height when rotated onto the same plane.

In accordance with embodiments of the invention, the cutting elements are arranged so that the oval cutting profiles 502*a-d* overlap the round cutting profiles 504*a-d* in their middle regions 506, as shown in FIG. 5B. Consequently, the cutting element density in the middle regions 506 extending to the tips 510, is higher than the density on the periphery 508. This causes the round cutting elements to wear down faster in the periphery 508 than in the reinforced middle regions 506 so that the cutting profiles 502*a-d* and 504*a-d* gradually become sharper, resembling the cutting profiles 502*a'-d'* and 504*a'-d'* of FIG. 5C. Such a self-sharpening process makes the cutting elements mechanically more efficient, thus improving ROP, especially in harder formations. In addition, the bottomhole pattern created as a result of the wear becomes more scalloped, leading to an increase in the magnitude of the restoration force needed to re-stabilize against vibrations, especially lateral and bit whirl. These advantages are critical for drilling performance improvements, especially in harder formations.

Figure 6:
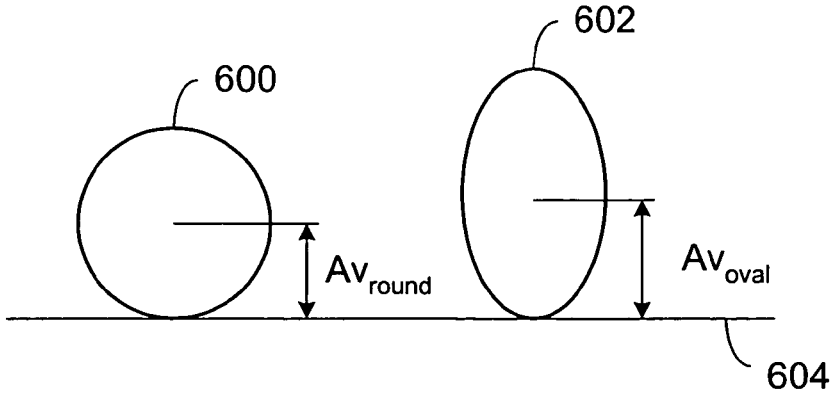
FIG. 6 illustrates exemplary axial volumes (Av) for cutting elements with different cutting surface geometries according to embodiments of the invention.

Note in the foregoing embodiments that the oval cutting elements have a cutting surface length (as measured along the major axis) that is greater than the cutting surface diameter of the round cutting elements. The longer cutting surface length provides the drill bit with an increased axial volume ("Av"). By way of background, the axial volume indicates how much of the superabrasive cutting surface of a cutting element is available for cutting/fracturing/breaking the formation material. The axial volume is typically defined in terms of the distance from the center of the superabrasive cutting surface to its tip. This is illustrated in FIG. 6, where a round cutting element 600 and an oval cutting element 602 are shown with the tips of their cutting surfaces contacting a borehole bottom 604. As can be seen, the oval cutting element 602 has an axial volume $Av_{oval}$ that is greater than an axial volume $Av_{round}$ of the round cutting element 600.

Those having ordinary skill in art understand that the axial volume of a cutting element affects the durability of that cutting element in hard and abrasive formations, such as limestone, dolomite, and other materials of high compressive strength values. Having a large axial volume also increases the ability of the cutting element to withstand high rotational speeds during the drilling process. Thus, a higher axial volume translates to a larger superabrasive area available for drilling and a longer lifespan for the drill bit in hard and abrasive formation material. For this reason, oval cutting elements, because of their comparatively higher Axial volume (Av), which maximizes their superabrasive material content, are known to be highly effective in abrasive formations or lithologies, such as sandstone and siltstone. In addition, any elongated cutting element (and even non-circular cutting elements) having a length (as measured along a major axis) that is greater than a diameter of the round cutting element is likely to be mechanically more effective at pre-fracturing of brittle formation material, such as limestone or dolomite, than the round cutting element. The advantage becomes more pronounced as the brittle materials become harder.

A round cutting element, however, is sometimes more effective than an oval cutting element in certain applications. Round cutting elements, for example, are more effective for shearing non-brittle formations or lithologies, such as shale, sandstones and siltstone. In addition, a round cutting surface, based on its peripheral curvature, generally has higher resistance to impact damage. In comparison to round cutting elements, an oval cutting element, based on its geometry, and specifically its major to minor axis ratio, has a relatively lower resistance to impact damage, particularly where the minor axis of the oval cutting element is less than the diameter of the round cutting element. Thus, in terms of application specificity, both oval cutting elements and round cutting elements, when used by themselves, are effective in only a limited number of applications.

In accordance with embodiments of the invention, oval cutting elements are employed in conjunction with round cutting elements. Such an arrangement combines the advantages of both round and oval cutting element types. The different cutter surface types establish nearly complete and independent bottomhole coverages. A drill bit in accordance with these embodiments of the invention lasts longer and is more effective for penetrating hard, brittle formation material (e.g., limestone, dolomite, carbonate, etc.) as well as non-brittle formation material (e.g., shale, sandstone, siltstone, etc.). In addition, wear is controlled so that it occurs more quickly in the periphery, thereby promoting sharpening of the cutting surfaces and improving bit stabilization. The improved stabilization minimizes cutting element impact damage, which further improves bit longevity.

The specific cutting surface dimensions of the round cutting elements and oval cutting elements, as well as the degree of elongation for the oval cutting elements, depend on the particular subsurface formation to be drilled. For example, a subsurface formation with high carbonate content may require cutting elements that are more oval or elongated for pre-fracturing purposes than a formation with high shale content. In one embodiment, the round cutting elements may have a cutting surface diameter of 16 mm and the oval cutting elements may have a cutting surface width of 16 mm and length of 19 mm (as measured along the minor and major axes, respectively). Of course, other diameters, widths, and lengths may also be used without departing from the scope of the invention. For example, in some embodiments, the oval cutting elements may have a cutting surface width that is larger than the cutting surface diameter of the round cutting elements. In a preferred embodiment, however, no oval cutting element completely contains or engulfs a round cutting element, and vice versa, as viewed according to their cutting profiles.

In operation, as the drill bit drills through non-brittle formation materials (e.g., sandstone, shale, siltstone, etc.), the lower density periphery of the cutting elements are worn down faster than the reinforced middle regions. This process promotes self-sharpening of round cutting elements and allows the drill bit to maintain or increase its effectiveness in hard and abrasive formation materials (e.g., limestone, carbonate, dolomite, etc.). In addition, the controlled wear pattern aligned to the periphery of the cutting surfaces due to the different density distributions also promotes stability, which is desirable for hard formation drilling. Furthermore, the larger axial volume (Av) of the oval cutting elements also enhances durability in hard and abrasive formations as well as in high rotational speed applications. Consequently, the drill bit is able to continue performing at an acceptable or economical ROP for longer periods of time or over longer intervals of drilling, especially upon encountering hard formation materials in comparison to conventional drill bits.

Thus far, only one type of oval cutting element, namely, a cutting element with an elliptical cutting surface, has been shown. As previously stated, however, other types of oval cutting elements may also be used so long as the oval cutting elements do not completely contain or engulf the round cutting elements (based on their cutting profiles), and vice versa. Examples of other oval cutting elements that may be used include cutting elements with egg-shaped, pear-shaped, teardrop, and similarly shaped cutting surfaces. In general, all oval cutting elements as well as non-circular and various common and customized cutting elements known to those having ordinary skill in the art may be used.

Figure 7:
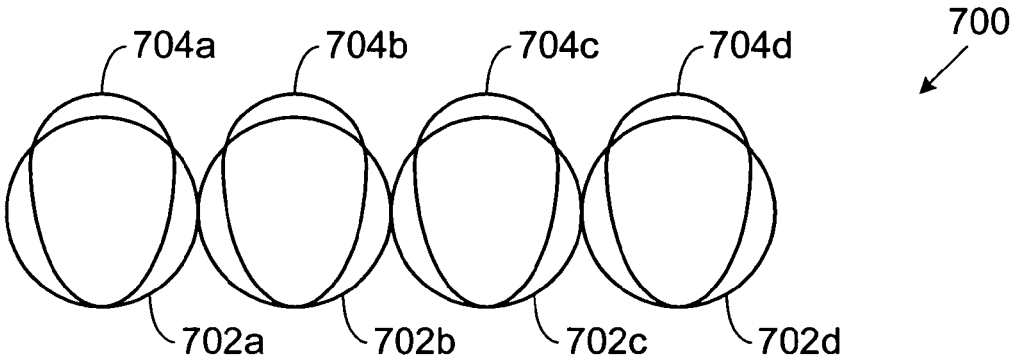
FIG. 7 illustrates exemplary cutting profiles for another exemplary fixed cutter drill bit having cutting elements with multiple cutting surface geometries according to embodiments of the invention.

FIG. 7 illustrates an embodiment of the invention in which an egg-shaped cutting element is used. As can be seen, an exemplary cutting profile 700 includes round cutting profiles 702*a-d* representing round cutting elements and egg-shaped cutting profiles 704*a-d* representing egg-shaped cutting elements. The cutting profiles 702*a-d* and 704*a-d* overlap one another in the middle, but do not completely contain or engulf one another. The disparate cutting element shapes and specific overlap create a zone of lower density on the periphery, but higher density in the middle regions. The zone of higher density has the effect of sharpening the tip regions of the cutting elements as wear progresses, making them increasingly effective and stable during drilling in hard and abrasive formations.

Figure 8:
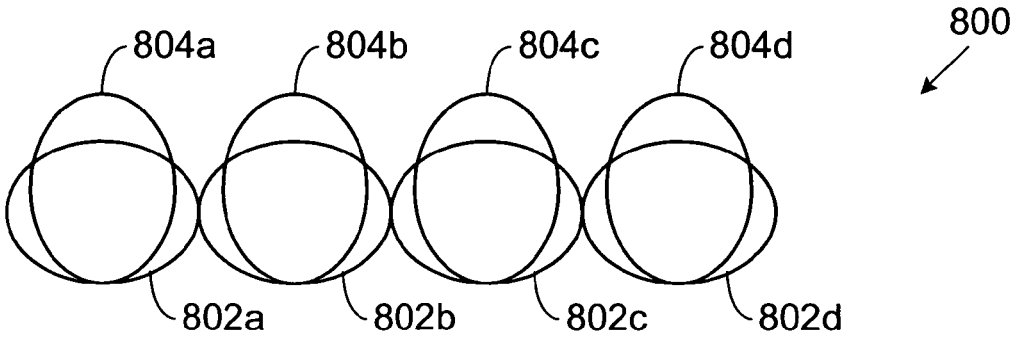
FIG. 8 illustrates exemplary cutting profiles for yet another exemplary fixed cutter drill bit having cutting elements with multiple cutting surface geometries according to embodiments of the invention.

FIG. 8 illustrates an exemplary cutting profile 800 for an embodiment of the invention where the cutting elements have substantially identical cutting surface sizes and shapes, but different orientations. As can be seen, the exemplary cutting profile 800 includes cutting profiles 802-*d* and 804*a-d* having substantially identical sizes and shapes, namely, oval shapes. One set of oval cutting profiles, for example, the first set 802-*d*, has a major axis oriented generally perpendicular to a profile of the drill bit (not expressly shown), while the other set of oval cutting profiles 804*a-d* has a major axis oriented generally parallel to the profile of the drill bit, such that perpendicular and parallel cutting profiles overlap, but do not completely contain or engulf one another.

The above arrangement of cutting profiles 802-*d* and 804*a-d* creates a zone of lower density on the periphery, but higher density in the middle regions. The benefits of such an arrangement are similar to those described previously in FIGS. 3-7 in terms of the effectiveness, stability, and durability of the drill bit for drilling in hard and abrasive formations. An additional benefit of the arrangement in FIG. 8 is that a single type of cutting element may be used to achieve multiple cutting profiles 802-*d* and 804*a-d*. This is possible due to the difference between the orientation of the major and minor axis of such a cutting element. In such a layout, all the benefits of the present invention, as discussed earlier are achieved.

In some embodiments, one of the overlapping cutting elements may be made more abrasion-resistant. For example, where round cutting elements and oval cutting elements are used, the round cutting elements may be made more abrasion-resistant than the oval cutting elements, or the oval cutting elements may be more abrasion-resistant than the round cutting elements. Or both the round and the oval cutting elements may have improved abrasion resistance. In a similar manner, the round cutting elements may be made more impact-resistant than the oval cutting elements, or the oval cutting elements may be more impact-resistant than the round cutting elements. Or both the round and the oval cutting elements may have improved impact resistance.

Based on the specifics of an application, as well as the formation types needed to be drilled, the different geometries will have different performance properties, in terms of abrasion and impact resistance, as well as thermal stability. In such instances, the material needs are used to augment and support the effects of the cutting element densities within the overlapping surfaces so as to promote or accelerate the peripheral wear. In instances where the round cutting elements are made with finer grain diamond material (giving them higher abrasion resistance in comparison to the oval cutting elements), the wear rate in the zone of reduced cutting element density is delayed. Likewise, when the oval cutting elements are made with finer grain diamond material (in comparison to the round cutting elements), the wear process in the zone of reduced cutting element density is accelerated. Through this process, the self-sharpening and improved stabilization benefits of the present invention can be tailored to match the performance requirements of specific applications, based on formation types, levels of shearing and/or pre-fracturing, expected run length, and ROP.

In another embodiment, the overlapping cutting elements may be treated to remove catalyzing material (e.g., cobalt), a process commonly referred to as "leaching." As is well known in the art, leaching or removal of catalyzing material from cutting elements can improve their thermally stability, thus allowing them to withstand much higher drilling temperatures before failing. Improved thermal stability drastically reduces the wear initiation process of the cutting elements. This process may be used to further enhance the performance properties of the circular and oval (and even non-circular) cutting elements, as described herein. Techniques for removal of catalyzing material from cutting elements are generally known and may be found, for example, in U.S. Pat. No. 6,544,308 entitled "High Volume Density Polycrystalline Diamond with Working Surfaces Depleted of Catalyzing Material," which is incorporated herein by reference. In accordance with embodiments of the invention, the round cutting elements may be treated to remove catalyzing material, or the oval cutting elements may be treated to remove catalyzing material. Or both the round and the oval cutting elements may be treated to remove catalyzing material.

It should be noted that regardless of the diamond material types (e.g., fine grain or coarse grain diamond materials) that may be used for the round and/or oval and/or non-circular cutting elements, or the leaching or catalyzing material depletion processes employed, the advantages, principles and teachings herein discussed for the present invention will all remain valid and fully applicable to these various embodiments.

Figure 9A:
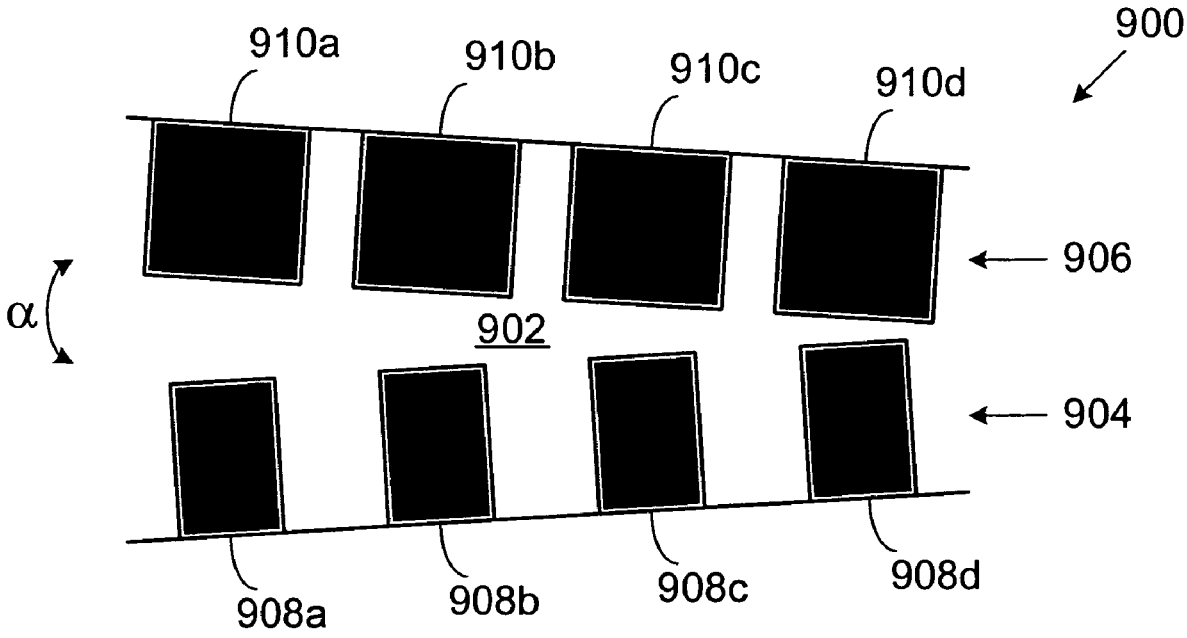
FIGS. 9A-9B illustrate an exemplary cutting element layout for still another exemplary fixed cutter drill bit having cutting elements with multiple cutting surface geometries according to embodiments of the invention.

Moreover, cutting profiles similar to the exemplary cutting profiles shown in FIGS. 5A-5C may also be derived from a drill bit where a single blade supports multiple rows of cutting elements. An exemplary implementation of these latter embodiments may be seen in FIGS. 9A-9B, which show a top view of an exemplary cutting element layout 900 for a blade 902 of a drill bit and the resulting cutting profile, respectively. As can be seen, the blade 902 has two rows of cutting elements, a front row 904 and a back row 906. Each row 904 and 906 is separated from the other row by a predetermined angle $\alpha$ and supports a plurality of cutting elements 908*a-d* and 910*a-d*, respectively.

In accordance with embodiments of the invention, the cutting elements 908*a-d* on the front row 904 and the cutting elements 910*a-d* on the back row 906 have different cutting surface geometry. In one implementation, the cutting surface geometry of the front row cutting elements 908*a-d* have an oval shape while the cutting surface geometry of the back row cutting elements 910*a-d* have a round shape. In addition, the radial positioning of the oval cutting elements 908*a-d* and the round cutting elements 910*a-d* along the front and back rows 904 and 906 is such that at least one oval cutting element 908*a-d* and at least one round cutting element 910*a-d* partially overlap in the middle regions, but without completely containing or engulfing each other when rotated onto the same radial plane.

Figure 9B:
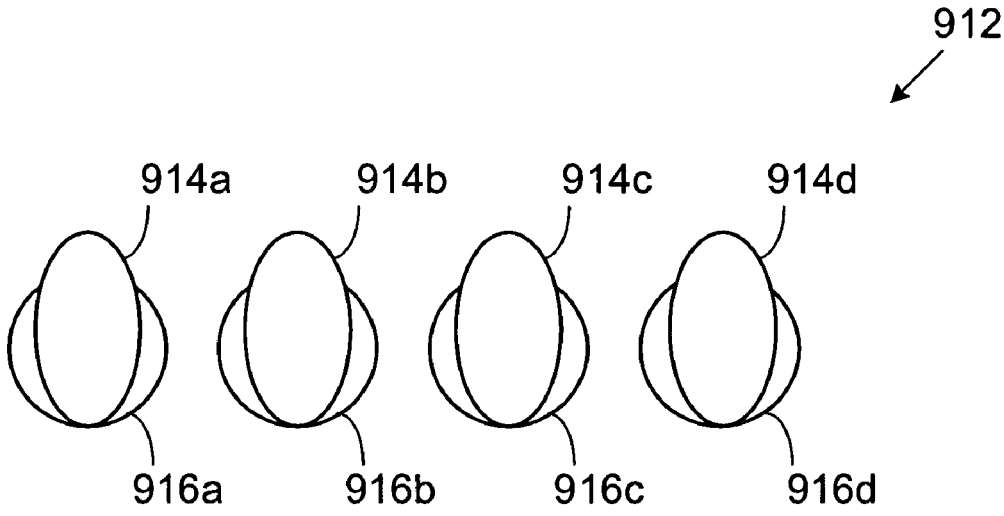

The above cutting element layout 900 results in the drill bit profile segment 912 shown in FIG. 9B. As can be seen, oval cutting profiles 914*a-d* representing the oval cutting elements 908*a-d* and round cutting profiles 916*a-d* representing the round cutting elements 910*a-d* overlap in their middle regions without completely containing or engulfing each other. Consequently, the cutting element density in the middle regions is higher than the cutting element density on the periphery. This causes the round cutting elements 910*a-d* to wear down faster in the periphery than in the reinforced middle regions. Such a self-sharpening process makes the cutting elements mechanically more efficient (particularly in harder formations), thus improving ROP. In addition, the bottomhole pattern created as a result of the controlled wear becomes more scalloped, thereby increasing the magnitude of the restoration force needed to re-stabilize the drill bit against vibrations (especially lateral vibrations and bit whirl). These advantages are critical for drilling performance improvements (particularly in harder formations).

Of course, the cutting surface geometries of the front row cutting elements 908*a-d* and the back row cutting elements 910*a-d* may be switched and the types of cutting elements present on each row may be intermixed together without departing from the scope of the invention. In addition, non-circular shapes known to those having ordinary skill in the art may also be used, including common and customized shapes. Finally, improved abrasion resistance, impact resistance, and/or thermal stability may be applied to either or both types of cutting elements in the manner described above without departing from the scope the invention.

While the present invention has been described with reference to one or more particular embodiments, those skilled in the art will recognize that many changes may be made thereto without departing from the scope of the invention. Accordingly, each of the foregoing embodiments and obvious variations thereof is contemplated as falling within the scope of the claimed invention, as is set forth in the following claims.

What is claimed is:

1. A drill bit, comprising:

a drill bit body;

first and second blades formed on said drill bit body;

a first cutting element mounted on said first blade, said first cutting element having a first cutting surface geometry corresponding to a first cutting profile; and a second cutting element mounted on said second blade, said second cutting element having a second cutting surface geometry corresponding to a second cutting profile;

wherein said first and second cutting elements are positioned on said first and second blades, respectively, so that said first and second cutting profiles partially overlap each other but the first cutting profile does not completely contain the second cutting profile and the second cutting profile does not completely contain the first cutting profile, said overlap creating a high density zone in a middle region provided by both of said first and second cutting profiles and a low density zone in a peripheral region provided on both sides of the middle region solely by said second cutting profile of the second cutting element; and wherein a cutting tip end of said mounted first cutting element is at substantially a same exposure height as a cutting tip end of said mounted second cutting element.

2. The drill bit according to claim 1, wherein one of said first and second cutting surface geometries has an oval shape and another one of said first and second cutting surface geometries has a round shape.

3. The drill bit according to claim 2, wherein said oval shape cutting surface geometry includes at least the following shapes: elliptical, egg-shaped, pear-shaped, and teardrop.

4. The drill bit according to claim 1, where said first and second cutting elements are centered at a common radial position on said first and second blades.

5. The drill bit according to claim 1, where said first and second cutting elements are centered at different radial positions on said first and second blades.

6. The drill bit according to claim 1, wherein one of said first and second cutting surface geometries has a non circular shape and another one of said first and second cutting surface geometries has a round shape.

7. The drill bit according to claim 1, wherein said first and second cutting surface geometries have substantially identical oval shapes, but different orientations.

8. The drill bit according to claim 1, wherein each one of said first and second cutting surface geometries has a major axis and a minor axis, and wherein the major axis is greater than the minor axis.

9. The drill bit according to claim 1, wherein said first and second cutting surface geometries have same axial volumes.

10. The drill bit according to claim 1, wherein said first and second cutting surface geometries have different axial volumes.

11. The drill bit according to claim 1, wherein one of said first and second cutting elements has a different diamond material grain size relative to another one of said first and second cutting elements, said different diamond grain size resulting in at least one of the following properties: improved abrasion resistance, improved impact resistance, and improved thermal stability.

12. The drill bit according to claim 1, wherein one of first and second cutting elements has undergone a catalyst removal process, said catalyst removal process resulting in at least one of the following properties: improved abrasion resistance, improved impact resistance, and improved thermal stability.

13. The drill bit according to claim 12, wherein said catalyst removal process is a cobalt removal process.

14. The drill bit according to claim 1, wherein both of said first and second cutting elements have undergone a catalyst removal process, said catalyst removal process resulting in at least one of the following properties: improved abrasion resistance, improved impact resistance, and improved thermal stability.

15. The drill bit according to claim 1, wherein said first and second cutting elements include one or more of the following cutting element types: tungsten carbide insert ("TCI"), polycrystalline diamond compact ("PDC"), thermally stable poly crystalline (TSP) and natural diamond.

16. A method of assembling a drill bit, comprising:

providing a drill bit body having first and second blades formed thereon;

mounting a first cutting element on said first blade, said first cutting element having a first cutting surface geometry corresponding to a first cutting profile;

mounting a second cutting element on said second blade, said second cutting element having a different second cutting surface geometry corresponding to a different second cutting profile; and positioning said first and second cutting elements on said first and second blades, respectively, so that said first and second cutting profiles partially overlap each other but the first cutting profile does not completely contain the second cutting profile and the second cutting profile does not completely contain the first cutting profile, said overlap creating a high density zone in a middle region provided by both of said first and second cutting profiles and a low density zone in a peripheral region provided on both sides of the middle region solely by said second cutting profile of the second cutting element;

wherein a cutting tip end of said mounted first cutting element is set at substantially a same exposure height as a cutting tip end of said mounted second cutting element.

17. The method according to claim 16, further comprising mounting only cutting elements having a first cutting surface geometry on said first blade, and mounting only cutting elements having said second cutting surface geometry on said second blade.

18. The method according to claim 16, further comprising mixing cutting elements having said first cutting surface geometry and cutting elements having said second cutting surface geometry on one of said first and second blades.

19. The method according to claim 16, further comprising aligning a major axis of one of said first and second cutting elements with a corresponding axis of another one of said first and second cutting elements so that said axes substantially line up with each other when said first and second cutting elements are rotated onto a same radial plane.

20. The method according to claim 16, wherein said first and second cutting surface geometries have substantially identical shapes, further comprising orienting one of said first and second cutting elements substantially perpendicularly to another one of said first and second cutting elements.

21. The method according to claim 16, further comprising combining cutting elements that are more effective for drilling in a first formation material with cutting elements that are more effective for drilling in a second formation material in said drill bit.

22. A drill bit, comprising:

a drill bit body;

first and second blades formed on said drill bit body;

a first cutting element mounted on said first blade, said first cutting element having a circular cutting surface geometry corresponding to a circular cutting profile with a first cutting tip end at an exposure height; and a second cutting element mounted on said second blade, said second cutting element having an oval cutting surface geometry corresponding to an oval cutting profile, but with a second cutting tip end which is at the same exposure height;

wherein said first and second cutting elements are positioned on said first and second blades, respectively, so that said circular and oval cutting profiles partially overlap each other but the circular cutting profile does not completely contain the oval cutting profile and the oval cutting profile does not completely contain the circular cutting profile, said overlap creating a high density zone in a middle region provided by both of said circular and oval cutting profiles of both the first and second cutting elements and a low density zone in a peripheral region provided on both sides of the middle region solely by said circular cutting profile of the first cutting element.

23. The drill bit according to claim 22, wherein said oval cutting surface geometry includes at least the following shapes: elliptical, egg shaped, pear shaped, and teardrop.

24. The drill bit according to claim 22, where said first and second cutting elements are centered at a common radial position on said first and second blades.

25. The drill bit according to claim 22, wherein the oval cutting surface geometry has a major axis and a minor axis, and wherein the major axis is oriented to define the location of the second cutting tip end.

26. A drill bit, comprising:

a drill bit body;

first and second blades formed on said drill bit body;

a first cutting element mounted on said first blade, said first cutting element having a cutting surface geometry corresponding to a certain cutting profile with a first cutting tip end at an exposure height; and a second cutting element mounted on said second blade, said second cutting element having an oval cutting surface geometry corresponding to an oval cutting profile, but with a second cutting tip end which is at the same exposure height;

wherein said first and second cutting elements are positioned on said first and second blades, respectively, so that said certain and oval cutting profiles partially overlap each other but the certain cutting profile does not completely contain the oval cutting profile and the oval cutting profile does not completely contain the certain cutting profile, said overlap creating a high density zone in a middle region provided by both of said certain and oval cutting profiles of the first and second cutting elements and a low density zone in a peripheral region provided on both sides of the middle region solely by said oval cutting profile of the second cutting element.

27. The drill bit according to claim 26, wherein said oval cutting surface geometry includes at least the following shapes: elliptical, egg shaped, pear shaped, and teardrop.

28. The drill bit according to claim 26, where said first and second cutting elements are centered at a common radial position on said first and second blades.

29. The drill bit according to claim 26, wherein the oval cutting surface geometry of the second cutting element has a major axis and a minor axis, and wherein the minor axis is oriented to define the location of the second cutting tip end.

30. The drill bit according to claim 29, wherein the cutting surface geometry of the first cutting element is an oval cutting surface geometry corresponding to an oval first cutting profile, and wherein the oval cutting surface geometry of the first cutting element has a major axis and a minor axis, and wherein the major axis is oriented to define the location of the first cutting tip end.

* * * * *

UNITED STATES PATENT AND TRADEMARK OFFICE

CERTIFICATE OF CORRECTION

PATENT NO. : 7,677,333 B2
APPLICATION NO. : 11/406470
DATED : March 16, 2010
INVENTOR(S) : Graham Mensa-Wilmot It is certified that error appears in the above-identified patent and that said Letters Patent is hereby corrected as shown below:

In the Claims:

At column 12, claim number 1, line number 35, please add the word -- different -- so that the line reads as follows:

said second cutting element having a different second cutting

At column 12, claim number 1, line numbers 36-37, please add the word -- different -- so that the lines read as follows:

surface geometry corresponding to a different second cutting profile;

Signed and Sealed this
Seventeenth Day of May, 2011

David J. Kappos

David J. Kappos
*Director of the United States Patent and Trademark Office*